US010589538B2

(12) United States Patent
Kojima

(10) Patent No.: US 10,589,538 B2
(45) Date of Patent: Mar. 17, 2020

(54) HEAD UNIT AND LIQUID DISCHARGING APPARATUS

(71) Applicant: SEIKO EPSON CORPORATION, Tokyo (JP)

(72) Inventor: Kenji Kojima, Milan (IT)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/874,425

(22) Filed: Jan. 18, 2018

(65) Prior Publication Data

US 2018/0215169 A1 Aug. 2, 2018

(30) Foreign Application Priority Data

Jan. 31, 2017 (JP) ..... 2017-015153

(51) Int. Cl.

| | |
|---|---|
| ***B41J 2/21*** | (2006.01) |
| ***B41J 2/045*** | (2006.01) |
| ***B41J 19/14*** | (2006.01) |
| ***B41J 2/51*** | (2006.01) |
| ***B41J 2/515*** | (2006.01) |
| *B41J 2/145* | (2006.01) |

(52) U.S. Cl.

CPC ..... *B41J 2/2132* (2013.01); *B41J 2/0458* (2013.01); *B41J 2/04568* (2013.01); *B41J 2/04576* (2013.01); *B41J 2/04581* (2013.01); *B41J 2/51* (2013.01); *B41J 2/515* (2013.01); *B41J 19/147* (2013.01); *B41J 2/145* (2013.01)

(58) Field of Classification Search

CPC .. B41J 2/2132; B41J 2/04568; B41J 2/04576; B41J 2/0458; B41J 2/04581; B41J 2/51; B41J 2/515; B41J 19/147; B41J 2/145

See application file for complete search history.

(56) References Cited

U.S. PATENT DOCUMENTS 6,293,650 B1 9/2001 Sette et al.
6,834,936 B2 * 12/2004 Teshigawara ..... B41J 19/147 347/40

(Continued)

FOREIGN PATENT DOCUMENTS

JP 2013-256075 A 12/2013
JP 2016-172378 A 9/2016

(Continued)

OTHER PUBLICATIONS

European Search Report issued in Application No. 18154065 dated Jun. 26, 2018.

*Primary Examiner* — Thinh H Nguyen
(74) *Attorney, Agent, or Firm* — Workman Nydegger

(57) ABSTRACT

A head unit includes heads arranged in a body. Each head includes a nozzle row arranged along a first direction. The heads are arranged along a second direction intersecting with the first direction. Two or more heads that include a nozzle row corresponding to a first color, are provided in each of a first region and a second region. A color corresponding to the nozzle row at an nth position from a first side is the same as a color corresponding to the nozzle row at an nth position from a second side, n being a positive integer, the first side being one side of the body in the second direction and the second side being another side of the body in the second direction.

12 Claims, 9 Drawing Sheets

(56) References Cited

U.S. PATENT DOCUMENTS

| | | | | |
|---|---|---|---|---|
| 6,997,542 | B2 * | 2/2006 | Takenaka | B41J 19/147 347/15 |
| 2012/0120152 | A1 | 5/2012 | Ogura et al. | |
| 2013/0335469 | A1 | 12/2013 | Saita et al. | |
| 2016/0288496 | A1 | 10/2016 | Koide et al. | |

FOREIGN PATENT DOCUMENTS

| | | | |
|---|---|---|---|
| JP | 2017-087429 | A | 5/2017 |
| JP | 2017-087451 | A | 5/2017 |
| WO | 2016140247 | | 9/2016 |

* cited by examiner

HEAD UNIT AND LIQUID DISCHARGING APPARATUS

BACKGROUND

1. Technical Field

The present invention relates to a head unit and a liquid discharging apparatus.

2. Related Art

A hitherto known liquid discharging apparatus performs printing on a medium by moving a head equipped with a row of nozzles to discharge a liquid, and a medium such as paper, relative to each other. In an industrial liquid discharging apparatus, a large scale head (head unit) installed with plural heads is employed in order to raise productivity. For example, JP-A-2013-256075 describes an ink jet recording apparatus (liquid discharging apparatus) that is equipped with an ink jet head (head unit) installed with six heads each corresponding to a liquid such as cyan, magenta, yellow, etc. The six heads are arranged along the row direction of the nozzle rows.

However, in the head unit provided in the liquid discharging apparatus described in JP-A-2013-256075, all the nozzles (nozzle rows) for discharging the liquid of a single color are formed in only a single head. Thus when performing printing while moving the medium and the head unit relative to each other in one direction and another direction intersecting the row direction of the nozzle rows, the sequence in which each color of liquid is discharged differs according to the direction of relative movement, with this leading to a concern related to a reduction in printing quality. Moreover, due to all the liquid of a single color being discharged from a single head, any individual differences between the heads will have an effect, with this leading to a concern related to a reduction in printing quality.

SUMMARY

Advantages of some aspects of the invention can be realized by the following application examples.

APPLICATION EXAMPLE 1

A head unit according to an application example includes a plurality of heads each including a nozzle row including a plurality of nozzles that discharge liquid onto a medium and are arranged along a first direction, and a body in which the plurality of the heads are arranged along a second direction intersecting with the first direction. In a case in which a region on one side of a center of the body in the second direction is taken as a first region and a region on another side of the center of the body in the second direction as a second region, two or more of the plurality of the heads each including the nozzle row corresponding to a first color are provided in each of the first region and the second region. In a case in which one side (i.e., edge or end) of the body in the second direction is taken as a first side (i.e., edge or end) and another side (i.e., edge or end) of the body in the second direction as a second side (i.e., edge or end), a color corresponding to the nozzle row at an nth position from the first side is the same as a color corresponding to the nozzle row at an nth position from the second side, with n being a positive integer.

According to this application example, the head unit includes two or more heads each including the nozzle row corresponding to a first color in each of the first region and the second region of the body. Moreover, a color corresponding to the nozzle row at an nth position from the first side of the head unit is the same as a color corresponding to the nozzle row at an nth position from the second side. Namely, the nozzle rows for to the first color are distributed over four or more heads, and the colors corresponding to the nozzle rows are disposed symmetrically about a center in the second direction. Thus, the sequence of discharge of the colors stays the same even if the direction of relative movement of the head unit and the medium changes, enabling discharge of the liquid for the same single color to be distributed over a plurality of heads. This enables a reduction in printing quality caused by the discharge sequence of the colors differing, or by individual differences between heads, to be suppressed from occurring.

APPLICATION EXAMPLE 2

In the head unit, it is preferable that the plurality of the heads disposed in the first region and the plurality of the heads disposed in the second region are disposed at different positions in the first direction.

According to this application example, the plurality of the heads disposed in the first region of the body and the head disposed in the second region of the body are disposed at different positions in the first direction. Thereby, even if streaks are formed along the second direction by the first direction end portions of the heads, such streaks can be made difficult to discern due to the streaks being distributed in the first direction.

APPLICATION EXAMPLE 3

In the head unit, it is preferable that the plurality of the heads disposed in at least one out of the first region or the second region include a first head and a second head, and the first head and the second head are disposed at different positions in the first direction.

According to this application example, the first head and the second head disposed in at least one of the first region or the second region are at different positions in the first direction. Thereby, even if streaks are formed along the second direction by the first direction end portions of the heads, such streaks can be made even more difficult to discern due to the streaks being even more distributed in the first direction.

APPLICATION EXAMPLE 4

In the head unit, it is preferable that in the first region, a color corresponding to the nozzle row at an nth position from the first side is the same as a color corresponding to the nozzle row at an nth position from the second side, with n being a positive integer. Moreover, it is preferable that in the second region, a color corresponding to the nozzle row at an nth position from the first side is the same as a color corresponding to the nozzle row at an nth position from the second side, with n being a positive integer.

According to this application example, in the first region of the head unit, the color corresponding to the nozzle row at the nth position from the first side is the same as the color corresponding to the nozzle row at the nth position from the second side, and in the second region of the head unit, the color corresponding to the nozzle row at the nth position from the first side is the same as the color corresponding to the nozzle row at an nth position from the second side. Namely, the nozzle rows corresponding to the first color are distributed over four or more heads, and in each region of the first region and the second region, the colors corresponding to the nozzle rows are disposed symmetrically about the centers of the first region and the second region in the second direction. Thus, the sequence of discharge of the colors stays the same even if the direction of relative movement of the head unit and the medium changes, enabling discharge of the liquid for the same single color to be distributed over a plurality of heads. Moreover, even in cases in which printing is performed using one region out of the first region or the second region, the sequence of discharge of the colors can be made to stay the same even if the direction of relative movement of the head unit and the medium changes. This enables a reduction in printing quality caused by the discharge sequence of the colors differing, or by individual differences between heads, to be suppressed from occurring.

APPLICATION EXAMPLE 5

A liquid discharging apparatus according to another application example includes the head unit of any one of the first application example to the fourth application example.

According to this application example, the liquid discharging apparatus includes the head unit configured as in any one of the first application example to the fourth application example, thereby enabling a reduction in printing quality caused by the discharge sequence of the colors differing, or by individual differences between heads, to be suppressed from occurring.

APPLICATION EXAMPLE 6

The liquid discharging apparatus preferably further includes a controller that controls the head unit so as to print an image on a medium. In a case in which a region in the head unit where a plurality of heads disposed in the first region and a plurality of heads disposed in the second region overlap with each other when viewed along the second direction is taken as an overlap region, and a region in the head unit where the plurality of heads disposed in the first region and the plurality of heads disposed in the second region do not overlap with each other when viewed along the second direction as a non-overlap region, the controller prints an image on the medium using the overlap region when executing printing in a first printing mode, and prints an image on the medium using the overlap region and the non-overlap region when executing printing in a second printing mode.

According to this application example, in the first printing mode, the controller executes printing using the overlap region. The overlap region is a region in which there are many nozzles in the second direction, and so images of high print quality can be obtained. Further, in the second printing mode, the controller executes printing using the overlap region and the non-overlap region. By using the overlap region and the non-overlap region, the number of nozzles in the first direction is increased, enabling printing speed to be increased.

APPLICATION EXAMPLE 7

The liquid discharging apparatus preferably further includes a transport section that transports the medium in the first direction. The head unit being configured to discharge liquid onto the medium while the head unit is moving along the second direction.

According to this application example, the liquid discharging apparatus includes the transport section that transports the medium in the first direction. The head unit discharging liquid onto the medium being transported in the first direction by the transport section while the head unit is moving along the second direction. The medium and the head unit thereby move relative to each other. Due to the liquid discharging apparatus configured in this manner including the head unit of any one of the first application example to the fourth application example, a reduction in printing quality caused by the discharge sequence of the colors differing, or by individual differences between heads, can be suppressed from occurring.

APPLICATION EXAMPLE 8

The liquid discharging apparatus preferably further includes a transport section that transports the medium in the second direction. The head unit being configured so as to discharge liquid onto the medium while the head unit is in a fixed state.

According to this application example, in the liquid discharging apparatus, the medium is transported in the second direction by the transport unit, and liquid is discharged from the fixed head unit. The medium and the head unit thereby move relative to each other. Due to the liquid discharging apparatus configured in this manner including the head unit of any one of the first application example to the fourth application example, a reduction in printing quality caused by the discharge sequence of the colors differing, or by individual differences between heads, can be suppressed from occurring.

BRIEF DESCRIPTION OF THE DRAWINGS

The invention will be described with reference to the accompanying drawings, wherein like numbers reference like elements.

DESCRIPTION OF EXEMPLARY EMBODIMENTS

A description of embodiments of the invention follows, with reference to the drawings. Note that each layer and each member in the accompanying drawings have being enlarged so as to be made visible, and so the scale of each layer and each member differs from their actual scaling.

For ease of explanation, an X axis, a Y axis, and a Z axis are illustrated as three mutually orthogonal axes in FIG. 1, FIG. 2, FIG. 7, and FIG. 8, with arrows illustrating the axial directions each having a leading end side indicating a "+ side", and having a base end side indicating a "− side". Directions parallel to the X axis are referred to as "X axis directions", directions parallel to the Y axis are referred to as "Y axis directions", and directions parallel to the Z axis are referred to as "Z axis directions".

First Embodiment

Schematic Configuration of Liquid Discharging Apparatus

Figure 1:
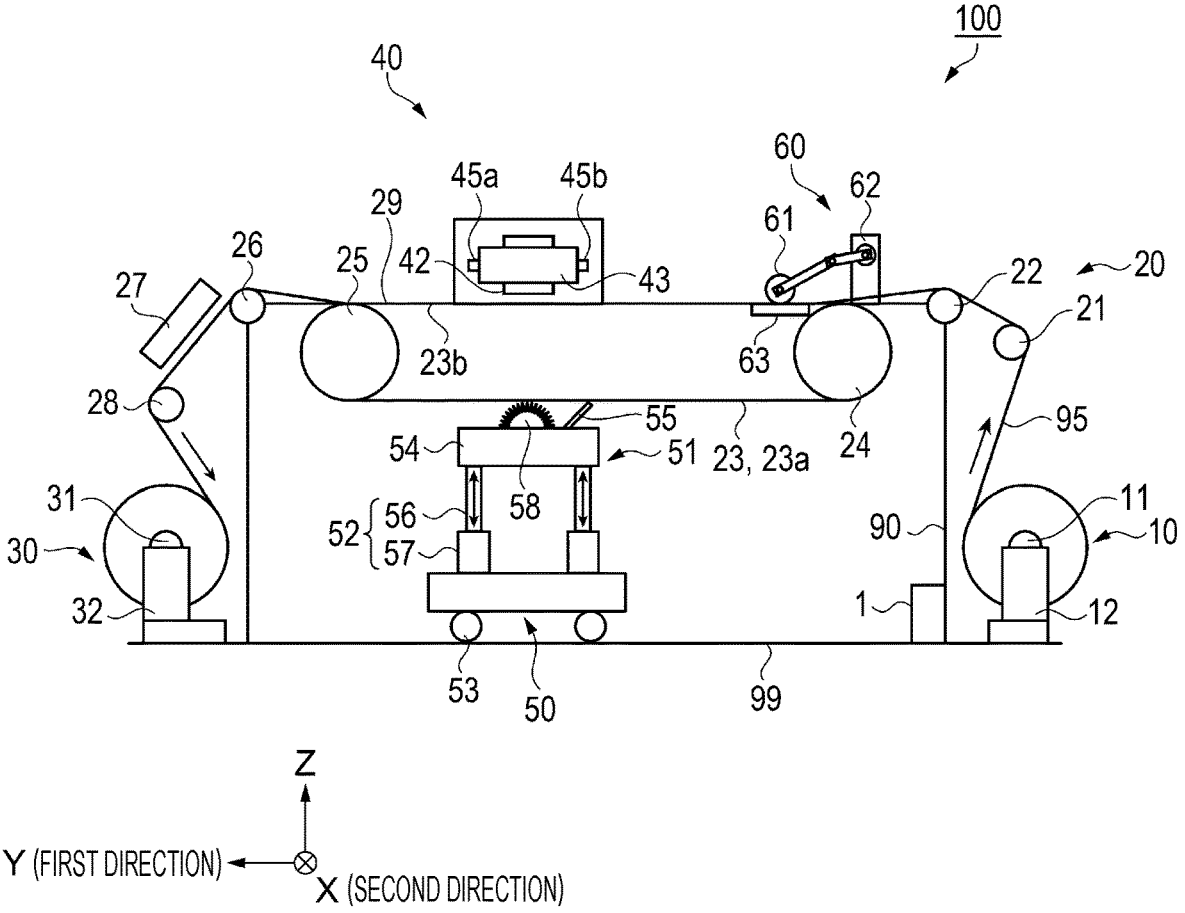
FIG. 1 is a schematic diagram illustrating an overall schematic configuration of a liquid discharging apparatus according to a first embodiment.
Figure 2:
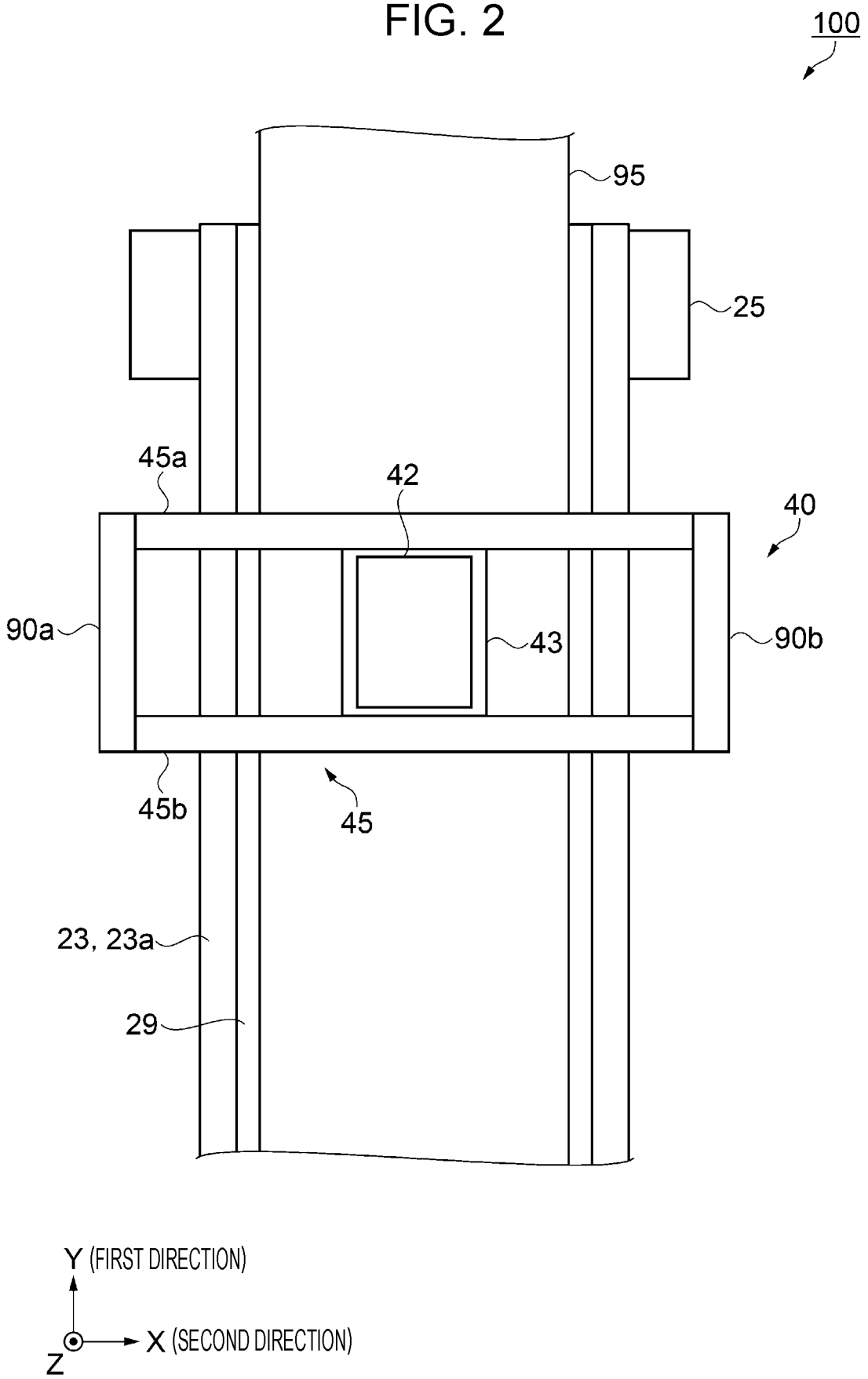
FIG. 2 is a plan view illustrating a printing unit of a liquid discharging apparatus.

FIG. 1 is a schematic diagram illustrating an overall schematic configuration of a liquid discharging apparatus according to the first embodiment. FIG. 2 is a plan view illustrating a printing unit of the liquid discharging apparatus. The schematic configuration of a liquid discharging apparatus 100 according to the present embodiment will now be described, with reference to FIG. 1 and FIG. 2. Note that in the present embodiment, an example will be given of a serial head liquid discharging apparatus 100 that performs printing by discharging liquid while moving a head unit 42 relative to a medium 95.

As illustrated in FIG. 1, the liquid discharging apparatus 100 includes a medium transport unit 20 serving as a transport section, a medium adhering unit 60, a printing unit 40, a drying unit 27, a cleaning unit 50, and the like. The liquid discharging apparatus 100 includes a controller 1 to control each of these units. Each of the units of the liquid discharging apparatus 100 is attached to a frame unit 90.

The medium transport unit 20 transports the medium 95 along a first direction in the printing unit 40. The medium transport unit 20 includes a medium feed unit 10, transport rollers 21, 22, a transport belt 23, a belt rotation roller 24, a belt drive roller 25, transport rollers 26, 28, and a medium collection unit 30. First, explanation follows regarding a transport path of the medium 95 from the medium feed unit 10 to the medium collection unit 30. Note that in the present embodiment, the direction of gravity is the Z axis, the direction along which the medium 95 is transported in the printing unit 40 is the Y axis, and a width direction of the medium 95 intersecting with both the Z axis and the Y axis is the X axis. Moreover, the Y axis corresponds to the first direction, and the X axis corresponds to a second direction. Moreover, positional relationships along the transport direction of the medium 95 and along a movement direction of the transport belt 23 are referred to by the terms "upstream" and "downstream".

In the medium feed unit 10, the medium 95 to form an image on is fed in from the side of the printing unit 40. A woven fabric or nonwoven fabric formed from natural fibers, cloth, silk, flax, mohair, wool, Kashmir, recycled fibers, synthetic fibers, nylon, polyurethane, polyester, and mixtures thereof, for example, may be employed as the medium 95. The woven fabric and the nonwoven fabric may be coated with a pretreatment agent in order to enhance color development and fixation properties. The medium feed unit 10 includes a feed shaft 11 and shaft bearings 12. The feed shaft 11 is formed in a cylindrical tube or circular bar shape, and is provided so as to be rotatable in a circumferential direction. The strip shaped medium 95 is wound in roll form around the feed shaft 11. The feed shaft 11 is detachably mounted to the shaft bearings 12. This enables the medium 95 in a pre-wound state on the feed shaft 11 to be mounted to the shaft bearings 12 together with the feed shaft 11.

The shaft bearings 12 rotatably support the feed shaft 11 at the two axial direction ends of the feed shaft 11. The medium feed unit 10 includes a rotational drive unit (not illustrated in the drawings) to rotationally drive the feed shaft 11. The rotational drive unit rotates the feed shaft 11 in a direction to feed out the medium 95. The operation of the rotational drive unit is controlled by the controller 1. The transport rollers 21, 22 relay the medium 95 from the medium feed unit 10 to the transport belt 23.

The transport belt 23 is held between at least two rollers for rotating the transport belt 23, and the medium 95 is transported in the +Y axis direction by rotational movement of the transport belt 23. More precisely, the transport belt 23 is formed in an endless belt shape in which the two ends of a strip shaped belt are connected together, and the transport belt 23 is entrained between two rollers, these being the belt rotation roller 24 and the belt drive roller 25. The transport belt 23 is held in a state in which a predetermined tension acts such that the portion of the transport belt 23 between the belt rotation roller 24 and the belt drive roller 25 is horizontal. An adhesive layer 29 to adhere the medium 95 is provided on a front face (support face) 23*a* of the transport belt 23. The transport belt 23 supports (holds) the medium 95 fed from the transport roller 22, and adhered to the adhesive layer 29 by the medium adhering unit 60, described later. This enables stretchable fabrics and the like to be employed as the medium 95.

The belt rotation roller 24 and the belt drive roller 25 support the inner peripheral face 23*b* of the transport belt 23. Note that a configuration may be adopted in which a support section such as a roller is provided to support the transport belt 23 between the belt rotation roller 24 and the belt drive roller 25.

The belt drive roller 25 transports the medium 95 in the +Y axis direction by rotationally moving the transport belt 23. The belt drive roller 25 includes a rotational drive unit (not illustrated in the drawings) to rotationally drive the belt drive roller 25. The belt drive roller 25 is provided downstream of the printing unit 40 in the medium 95 transport direction (Y axis direction), and the belt rotation roller 24 is provided upstream of the printing unit 40. When the belt drive roller 25 is rotationally driven, the transport belt 23 is rotationally moved accompanying rotation of the belt drive roller 25, and the belt rotation roller 24 is rotated by the rotational movement of the transport belt 23. The medium 95 supported by the transport belt 23 is transported in the +Y axis direction by the rotation of the transport belt 23, and an image is formed on the medium 95 by the printing unit 40, as described later.

In the present embodiment, on the side where the front face 23*a* of the transport belt 23 faces the printing unit 40 (the +Z axis side), the medium 95 is supported thereon and the medium 95 is transported together with the transport belt 23 from the belt rotation roller 24 side to the belt drive roller 25 side. Moreover, on the side where the front face 23*a* of the transport belt 23 faces the cleaning unit 50 (the −Z axis side), the transport belt 23 alone is moved from the belt drive roller 25 side to the belt rotation roller 24 side. Note that although the transport belt 23 is described as having the adhesive layer 29 to adhere the medium 95, there is no limitation thereto. For example, the transport belt may be an electrostatic belt that adheres the medium electrostatically.

The transport roller 26 releases the image-formed medium 95 from the adhesive layer 29 of the transport belt 23. The transport rollers 26, 28 relay the medium 95 from the transport belt 23 to the medium collection unit 30.

The medium collection unit 30 collects in the medium 95 transported by the medium transport unit 20. The medium collection unit 30 includes a take-up shaft 31 and shaft bearings 32. The take-up shaft 31 is formed in a cylindrical tube or circular bar shape, and is provided so as to be rotatable in a circumferential direction. The strip shaped medium 95 is taken up in a roll shape on the take-up shaft 31. The take-up shaft 31 is detachably mounted to the shaft bearings 32. The medium 95 in a state taken up on the take-up shaft 31 can thereby be removed together with the take-up shaft 31.

The shaft bearings 32 rotatably support the two axial direction ends of the feed shaft 31. The medium collection unit 30 includes a rotational drive unit (not illustrated in the drawings) to rotationally drive the take-up shaft 31. The rotational drive unit rotates the take-up shaft 31 in the direction to take-up the medium 95. The operation of the rotational drive unit is controlled by the controller 1.

Next, description follows regarding each of the units provided along the medium transport unit 20, i.e. the medium adhering unit 60, the printing unit 40, the drying unit 27, and the cleaning unit 50.

The medium adhering unit 60 adheres the medium 95 to the transport belt 23. The medium adhering unit 60 is provided upstream (on the −Y axis side) of the printing unit 40 in the transport direction (Y axis direction). The medium adhering unit 60 includes a press roller 61, a press roller driver 62, and a roller support 63. The press roller 61 is formed in a cylindrical tube or circular bar shape, and is provided so as to be rotatable in a circumferential direction. The press roller 61 is disposed with its axial direction intersecting with the transport direction, so as to rotate in a direction along the transport direction. The roller support 63 is provided on the inner peripheral face 23*b* side of the transport belt 23, so as to face the press roller 61 across the transport belt 23.

While pressing the press roller 61 downward in the vertical direction (toward the −Z axis side), the press roller driver 62 moves the press roller 61 in the transport direction (the +Y axis direction), and in the opposite direction to the transport direction (the −Y axis direction). The medium 95 superimposed on the transport belt 23 is pressed against the transport belt 23 between the press roller 61 and the roller support 63. This enables the medium 95 to be reliably adhered to the adhesive layer 29 provided on the front face 23*a* of the transport belt 23, and enables the medium 95 to be prevented from lifting up off the transport belt 23.

The printing unit 40 is disposed above (on the +Z axis side of) the placement position of the transport belt 23, and prints on the medium 95 lying on the front face 23*a* of the transport belt 23. The printing unit 40 includes the head unit 42, a carriage 43 mounted with the head unit 42, a carriage mover 45 to move the carriage 43 in the width direction of the medium 95 (the X axis direction) intersecting the transport direction of the medium 95 (the Y axis direction), and the like.

The carriage mover 45 is provided above (on the +Z axis side of) the transport belt 23. The carriage mover 45 includes a pair of guide rails 45*a*, 45*b* extending along the X axis direction. The guide rails 45*a*, 45*b* span between vertical frame sections 90*a*, 90*b* provided at the outsides of the transport belt 23. The head unit 42 is supported by the guide rails 45*a*, 45*b* in a state in which the head unit 42 is capable of being moved together with the carriage 43 to-and-fro along the X axis direction.

The carriage mover 45 includes a movement mechanism and a drive source (neither of which is illustrated in the drawings) to move the carriage 43 along the guide rails 45*a*, 45*b*. The movement mechanism may, for example, employ a mechanism combining a ballscrew and a ballnut, a linear guide mechanism, or the like. Various motors, such as a stepping motor, a servomotor, or a linear motor, may be employed as the drive source. When the motor is driven under control of the controller 1, the head unit 42 is moved along the X axis direction together with the carriage 43 by the movement mechanism.

The drying unit 27 is provided between the transport roller 26 and the transport roller 28. The drying unit 27 dries ink discharged as liquid onto the medium 95. The drying unit 27 includes, for example, an IR heater, and ink that has been discharged onto the medium 95 can be dried in a short period of time by driving the IR heater. This enables the strip shaped medium 95 formed with an image or the like to be taken up on the take-up shaft 31.

The cleaning unit 50 is disposed between the belt rotation roller 24 and the belt drive roller 25 in the Y axis direction. The cleaning unit 50 includes a cleaning section 51, a pressing section 52, and a moving section 53. The moving section 53 moves the cleaning unit 50 as an integrated unit along a floor surface 99, and fixes the cleaning unit 50 at a predetermined position.

The pressing section 52 is, for example, a raising-lowering device configured by air cylinders 56 and ball bushings 57, and causes the cleaning section 51 provided above the pressing section 52 to make contact with the front face 23*a* of the transport belt 23. The cleaning section 51 cleans the front face 23*a* (support face) of the transport belt 23 as the transport belt 23 moves from the belt drive roller 25 toward the belt rotation roller 24 from the lower (the −Z axis direction) side of the front face 23*a*, where there is a state in which a predetermined tension acts on the transport belt 23 between the belt rotation roller 24 and the belt drive roller 25.

The cleaning section 51 includes a cleaner tank 54, a cleaning roller 58, and a blade 55. The cleaner tank 54 is a tank holding cleaning liquid used to clean ink and other matter adhered to the front face 23*a* of the transport belt 23. The cleaning roller 58 and the blade 55 are installed inside the cleaner tank 54. Water or a water soluble solvent (such an aqueous alcohol solution) may, for example, be employed as the cleaning liquid, and a surfactant or anti-foaming agent may be added to the cleaning liquid if required.

The cleaning liquid is supplied to the front face 23*a* of the transport belt 23 by the rotation of the cleaning roller 58, with the cleaning roller 58 and the transport belt 23 sliding against each other. Ink, fibers of the cloth serving as the medium 95, and the like that has become adhered to the transport belt 23 are thereby removed by the cleaning roller 58.

The blade 55 may, for example, be formed by a flexible material such as silicone rubber. The blade 55 is provided downstream of the cleaning roller 58 in the transport direction of the transport belt 23. Any cleaning liquid remaining on the front face 23*a* of the transport belt 23 is removed by the sliding action between the transport belt 23 and the blade 55.

Figure 3:
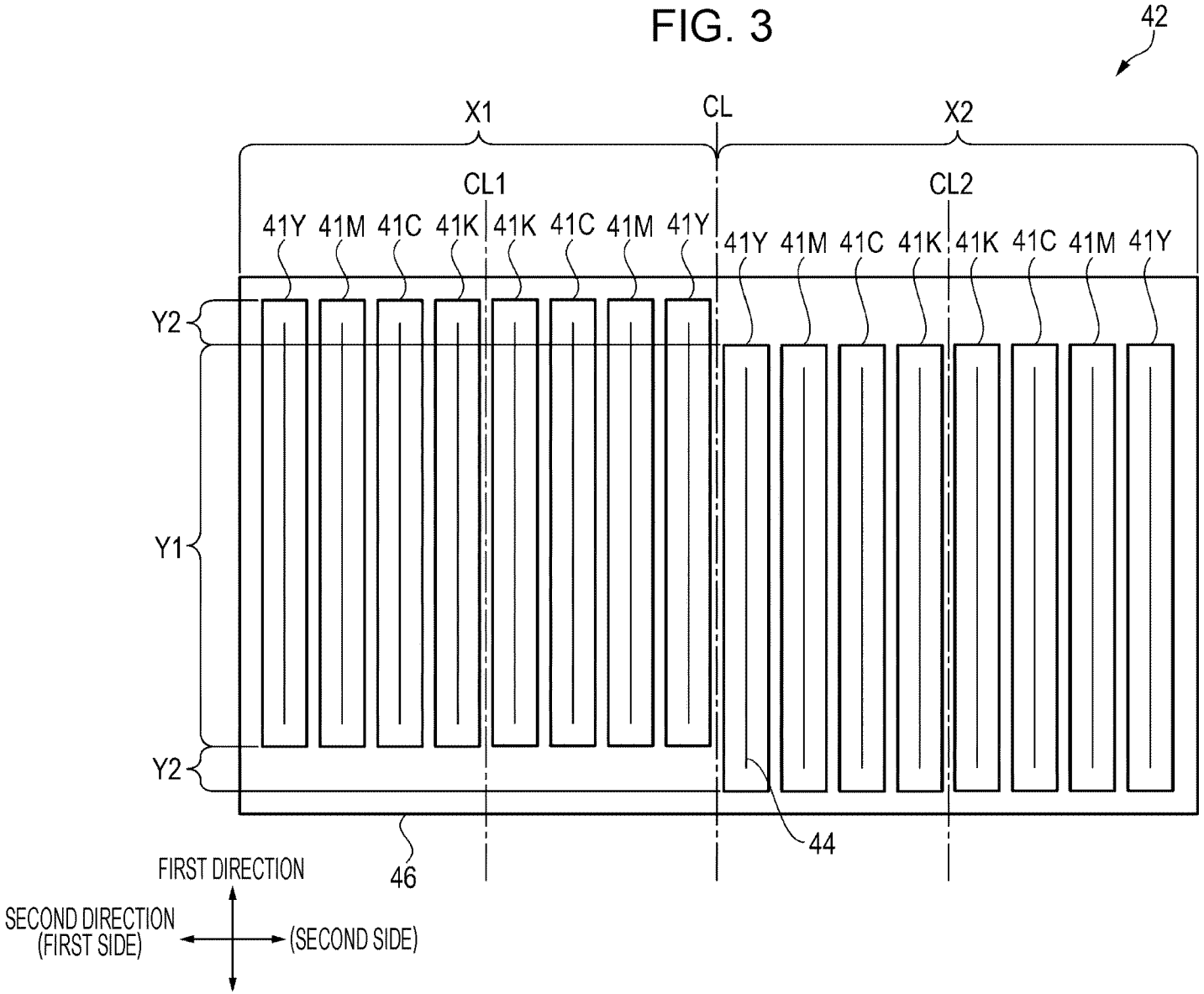
FIG. 3 is a plan view illustrating a configuration of a head unit.
Figure 4:
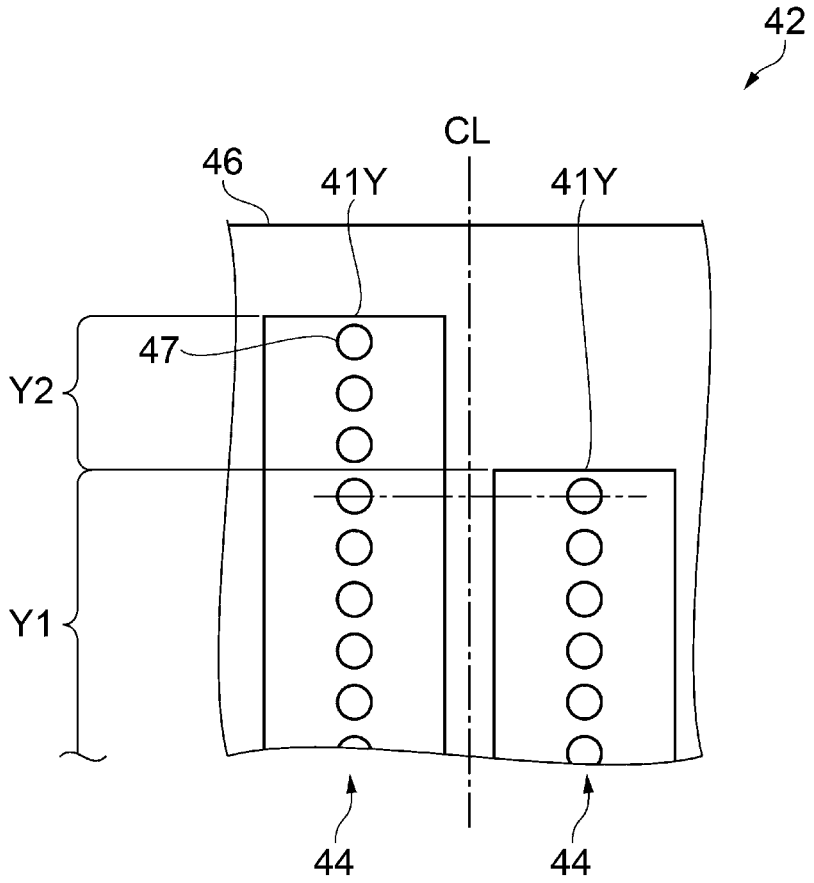
FIG. 4 is a partial enlarged diagram of a head unit.
Figure 4:
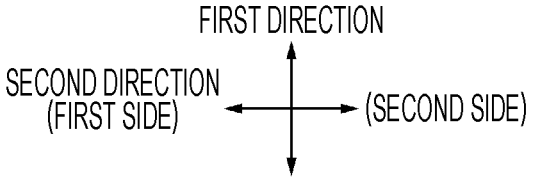

FIG. 3 is a plan view illustrating a configuration of a head unit. FIG. 4 is an enlarged partial view of the head unit. Next, explanation follows regarding configuration of the head unit 42, with reference to FIG. 3 and FIG. 4.

The liquid discharging apparatus 100 is equipped with the head unit 42 illustrated in FIG. 3 and FIG. 4. The head unit 42 includes heads 41Y, 41M, 41C, 41K; and a body 46. The heads 41Y, 41M, 41C, 41K each include a nozzle row 44 in which plural nozzles 47 for discharging liquid onto the medium 95 are arranged along a first direction (the Y axis direction in the present embodiment). On the body 46, the plural heads 41Y, 41M, 41C, 41K are arranged along a second direction (the X axis direction in the present embodiment) intersecting with the first direction.

The head unit 42 is configured so as to discharge liquid such as ink onto the medium 95 while being moved along the second direction by the carriage mover 45 described above.

In the head 41Y, for example, a yellow ink is supplied from an ink supply section, not illustrated in the drawings, and the yellow ink is discharged from the nozzles 47 toward the medium 95.

In the head 41M, for example, a magenta ink is supplied from an ink supply section, not illustrated in the drawings, and the magenta ink is discharged from the nozzles 47 toward the medium 95.

In the head 41C, for example, a cyan ink is supplied from an ink supply section, not illustrated in the drawings, and the cyan ink is discharged from the nozzles 47 toward the medium 95.

In the head 41K, for example, a black ink is supplied from an ink supply section, not illustrated in the drawings, and the black ink is discharged from the nozzles 47 toward the medium 95.

The inks supplied to the heads 41Y, 41M, 41C, 41K can be discharged from the nozzles 47 as droplets of liquid due to the application of pressure using bubbles generated by a heat generating body, a piezoelectric element, electrostatic force, or the like.

Note that in the following description, heads will be referred to as "heads 41" when the color of ink is not specified.

The head unit 42 contains two regions: a first region X1, which is a region on one side of the center (central line CL) of the body 46 in the second direction; and a second region X2, which is a region on the other side of the center of the body 46 in the second direction. In each of the first region X1 and the second region X2, there are two or more heads 41, with each of the heads 41 provided with a nozzle row 44 corresponding to a first color.

For example, in the head unit 42 of the present embodiment, if the first color is yellow, then two of the heads 41Y each including a nozzle row 44 corresponding to yellow are provided in each of the first region X1 and the second region X2.

Similarly, two of the heads 41M corresponding to magenta, the heads 41C corresponding to cyan, and the heads 41K corresponding to black are provided in each of the first region X1 and the second region X2. In other words, the liquid of the first color is discharged from the nozzle rows 44 provided in four different heads 41, enabling a reduction in printing quality caused by individual differences between heads to be suppressed from occurring.

Moreover, if the one side (i.e., edge or end) of the body 46 in the second direction is taken as a first side (i.e., edge or end), and the other side (i.e., edge or end) of the body 46 in the second direction is taken as a second side (i.e., edge or end), then the color corresponding to nozzle row 44 in the nth position from the first side (wherein n is a positive integer), is the same as the color corresponding to the nozzle row 44 in the nth position from the second side.

For example, the nozzle rows 44 corresponding to yellow are arranged at the first and eighth positions from the first side, and at the first and eighth positions from the second side.

The nozzle rows 44 corresponding to magenta are arranged at the second and seventh positions from the first side, and at the second and seventh positions from the second side.

The nozzle rows 44 corresponding to cyan are arranged at the third and sixth positions from the first side, and at the third and sixth positions from the second side. The nozzle rows 44 corresponding to black are arranged at the fourth and fifth positions from the first side, and at the fourth and fifth positions from the second side.

Namely, the colors corresponding to each of the nozzle rows 44 are arranged so as to be symmetrical about the central line CL. This means that discharge sequence of each of the colors is the same when ink is being discharged while the head unit 42 is on the outbound stroke, as when ink is being discharged while the head unit 42 is on the return stroke. This enables a reduction in printing quality caused by the discharge sequence of the colors differing to be suppressed from occurring.

Furthermore, in the first region X1 of the head unit 42, the color corresponding to the nozzle row 44 at the nth position from the first side (wherein n is a positive integer) is the same as the color corresponding to the nozzle row 44 at the nth position from the second side. In the second region X2 of the head unit 42, the color corresponding to the nozzle row 44 at the nth position from the first side is the same as the color corresponding to the nozzle row 44 at the nth position from the second side.

For example, the nozzle rows 44 corresponding to yellow are disposed in the first region X1 at the first position from the first side and the first position from the second side, and are disposed in the second region X2 at the first position from the first side and at the first position from the second side.

The nozzle rows 44 corresponding to magenta are disposed in the first region X1 at the second position from the first side and the second position from the second side, and are disposed in the second region X2 at the second position from the first side and at the second position from the second side.

The nozzle rows 44 corresponding to cyan are disposed in the first region X1 at the third position from the first side and the third position from the second side, and are disposed in the second region X2 at the third position from the first side and at the third position from the second side.

The nozzle rows 44 corresponding to black are disposed in the first region X1 at the fourth position from the first side and the fourth position from the second side, and are disposed in the second region X2 at the fourth position from the first side and at the fourth position from the second side.

Namely, the colors corresponding to the respective nozzle rows 44 in the first region X1 are arranged so as to be symmetrical with respect to a central line CL1 in the second direction of the first region X1, and the colors corresponding to the respective nozzle rows 44 in the second region X2 are arranged so as to be symmetrical with respect to a central line CL2 in the second direction of the second region X2.

Thus, when printing using one region of the head unit 42 from out of the first region X1 and the second region X2, the discharge sequence for the colors is the same when ink is being discharged while the head unit 42 on the outbound stroke, as when ink is being discharged while the head units 42 is on the return stroke, enabling a reduction in printing quality caused by the discharge sequence of the colors differing to be suppressed from occurring.

Moreover, the heads 41 disposed in the first region X1 and the heads 41 disposed in the second region X2 are disposed at different positions in the first direction. For example, as illustrated in FIG. 4, in the head unit 42 of the present embodiment, the position of the heads 41Y, 41M, 41C, 41K disposed in the second region X2 are shifted in the first direction by a distance equivalent to three nozzles with respect to the positions of the heads 41Y, 41M, 41C, 41K disposed in the first region X1. Thus, even if streaks are formed along the second direction by the first direction end portions of the heads 41Y, 41M, 41C, 41K, such streaks can be made difficult to discern due to the streaks being distributed in the first direction. In other words, any streaks formed along the second direction are distributed in the first direction and made difficult to discern, enabling images to be printed on the medium 95 with a small number of passes. This enables the productivity of the liquid discharging apparatus 100 to be raised.

Note that in the following description, a region in the head unit 42 where the heads 41Y, 41M, 41C, 41K disposed in the first region X1, and the heads 41Y, 41M, 41C, 41K disposed in the second region X2, overlap with each other when viewed along the second direction (X axis direction) is called an overlap region Y1. Moreover, a region where the heads 41Y, 41M, 41C, 41K disposed in the first region X1, and the heads 41Y, 41M, 41C, 41K disposed in the second region X2, do not overlap with each other when viewed along the second direction (X axis direction) is called a non-overlap region Y2.

Electrical Configuration

Figure 5:
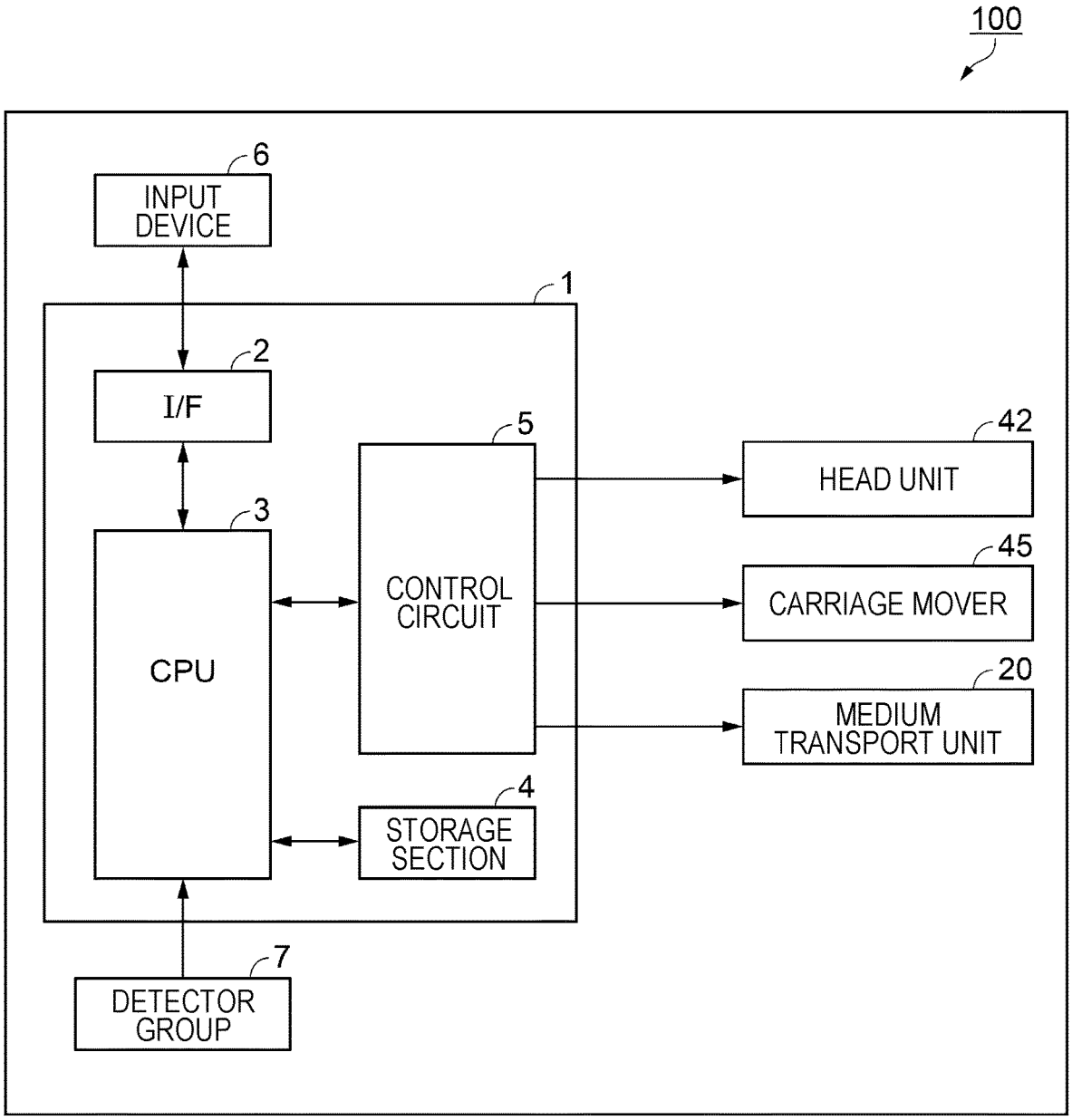
FIG. 5 is an electrical block diagram illustrating an electrical configuration of a liquid discharging apparatus.

FIG. 5 is an electrical block diagram illustrating an electrical configuration of a liquid discharging apparatus. Description follows of the electrical configuration of the liquid discharging apparatus 100, with reference to FIG. 5.

The liquid discharging apparatus 100 includes an input device 6 that is input with printing information and the like, and the controller 1 that controls each of the units and the head unit 42 in the liquid discharging apparatus 100 so as to cause images to be printed on the medium 95, and the like. A desktop or laptop personal computer (PC), a tablet terminal, a portable terminal, or the like, may be employed as the input device 6. The input device 6 may be provided separately to the liquid discharging apparatus 100.

The controller 1 is configured including an interface (I/F) 2, a central processing unit (CPU) 3, a storage section 4, a control circuit 5, and the like. The interface 2 exchanges data between the input device 6, which handles the input signal and images, and the controller 1. The CPU 3 is an arithmetic processing device to perform input signal processing on various input signals from a detector group 7, and to control the printing operation of the liquid discharging apparatus 100.

The storage section 4 is a storage medium to secure a region for storing programs for the CPU 3 and to act as a working area for the CPU 3, and encompasses storage elements such as random access memory (RAM), Electrically Erasable Programmable Read Only Memory (EEPROM), and the like.

The controller 1 uses control signals output from the control circuit 5 to control driving of the heads 41Y, 41M, 41C, 41K installed in the head unit 42, so as to cause ink to be discharged toward the medium 95. The controller 1 uses control signals output from the control circuit 5 to control driving of the motor installed in the carriage mover 45 so as to move the carriage 43 mounted with the head unit 42 to-and-fro in the second direction (X axis direction). The controller 1 uses control signals output from the control circuit 5 to control a rotational drive section included in each section of the medium transport unit 20 so as to move the medium 95 lying on the transport belt 23 in the first direction (+Y axis direction). Moreover, the controller 1 controls various non-illustrated devices.

The controller 1 forms images or the like on the medium 95 by performing a printing operation. In the printing operation, the carriage mover 45 and the head unit 42 are controlled to move the head unit 42 (the carriage 43) in the second direction while discharging ink from the heads 41 in a primary scan (pass), and the medium transport unit 20 is controlled so as to transport the medium 95 in the first direction in a secondary scan, with the primary scanning and the secondary scan alternately repeated.

Printing Method

Figure 6:
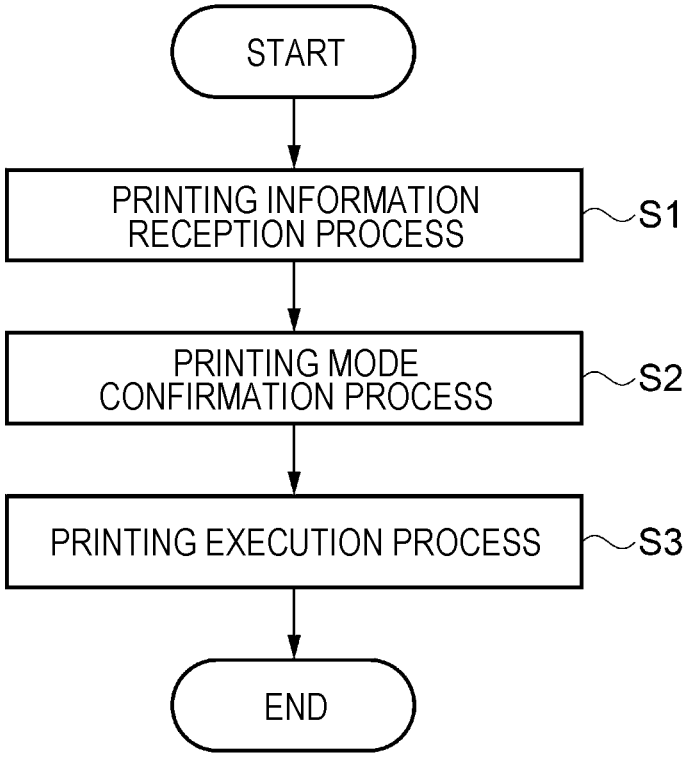
FIG. 6 is a flow chart to explain a printing method.

FIG. 6 is a flowchart to explain a printing method. Description follows regarding the printing method of the liquid discharging apparatus 100, with reference to FIG. 6.

Step S1 is a printing information reception process to receive printing information. The controller 1 receives printing information from the input device 6 containing information such as printing data and printing mode for recording images on the medium 95, and stores the received information in the storage section 4.

Step S2 is a printing mode confirmation process to confirm the printing mode received at step S1. The printing mode may be a first printing mode to print an image on the medium 95 using the overlap region Y1, or a second printing mode to print an image on the medium 95 using the overlap region Y1 and the non-overlap region Y2.

Step S3 is a printing execution process to execute printing on the medium 95. The controller 1 controls the head unit 42, the carriage mover 45, and the medium transport unit 20 in concert with each other so as to execute printing according to the printing data.

When doing so, when the printing mode is the first printing mode, the controller 1 executes printing using the nozzles 47 of the overlap region Y1. The overlap region Y1 is a region in which there are many nozzles 47 in the second direction (X axis direction) and so an image of high print quality can be obtained.

Moreover, when the printing mode is the second printing mode, the controller 1 executes printing using the nozzles 47 of the overlap region Y1 and the non-overlap region Y2. The number of the nozzles 47 in the first direction (+Y axis direction) is increased by employing the non-overlap region Y2 in addition to the overlap region Y1, enabling printing speed to be increased. This enables the productivity of the liquid discharging apparatus 100 to be raised.

Then, after printing has finished, the controller 1 ends operation of the liquid discharging apparatus 100.

Note that although a configuration of the head unit 42 of the present embodiment is illustrated in which there is one nozzle row 44 disposed in one head 41, there is no limitation thereto.

For example, configuration may be made with two nozzle rows for discharging different colors disposed in one head. Moreover, configuration may be made with two nozzle rows in one head, with one nozzle row disposed so as to be shifted in the first direction, with respect to the other nozzle row, by a distance corresponding to ½ the nozzle pitch.

As described above, the head unit 42 and the liquid discharging apparatus 100 according to the present embodiment enable the following advantageous effects to be obtained.

In the head unit 42 there are two or more of the heads 41 respectively provided in the first region X1 and the second region X2 of the body 46, with each of these heads 41 including a nozzle row 44 corresponding to the first color. In other words, the liquid of the first color is discharged from the nozzle rows 44 provided in four different heads 41. This enables a reduction in printing quality caused by individual differences between the heads 41 to be suppressed from occurring.

Moreover, the colors corresponding to each of the nozzle rows 44 are disposed symmetrically about the central line CL of the body 46 in the second direction. Thus, the discharge sequence of each of the colors is the same when ink is being discharged while the head unit 42 is on the outbound stroke, as when ink is being discharged while the head unit 42 is on the return stroke, thereby enabling a reduction in printing quality caused by the discharge sequence of the colors differing to be suppressed from occurring.

The colors corresponding to each of the nozzle rows 44 in the first region X1 of the head unit 42 are disposed so as to be symmetrical about the central line CL1 of the first region X1 in the second direction, and the colors corresponding to each of the nozzle rows 44 in the second region X2 are disposed so as to be symmetrical about the central line CL2 of the second region X2 in the second direction. Thus, even when printing using one region of the head unit 42 from out of the first region X1 and the second region X2, the discharge sequence for the colors is the same when ink is being discharged while the head unit 42 on the outbound stroke as when ink is being discharged while the head units 42 is on the return stroke, enabling a reduction in printing quality caused by the discharge sequence of the colors differing to be suppressed from occurring.

The head unit 42 has the positions of the heads 41 disposed in the second region X2 shifted in the first direction with respect to the positions of the heads 41 disposed in the first region X1. Thus, even when streaks are formed along the second direction by the first direction end portions of the heads 41, such streaks can be made difficult to discern due to the streaks being distributed in the first direction. Moreover, due to any streaks formed along the second direction being distributed in the first direction and made difficult to discern, images can be printed on the medium 95 with a small number of passes. This enables the productivity of the liquid discharging apparatus 100 to be raised.

The liquid discharging apparatus 100 includes the medium transport unit 20 to transport the medium 95 in the first direction, and liquid is discharged toward the medium 95 that has been transported in the first direction by the medium transport unit 20 while moving the head unit 42 in the second direction. Thus, the medium 95 and the head unit 42 are moved relative to each other, and an image is printed on the medium 95. In the liquid discharging apparatus 100 configured as described above, the head unit 42 employed is able to suppress a reduction in printing quality such as that caused by the discharge sequence of the colors differing or that caused by individual differences between the heads 41. Consequently, the liquid discharging apparatus 100 is able to suppress a reduction in printing quality such as that caused by the discharge sequence of the colors differing or that caused by individual differences between the heads 41.

When the printing mode is the first printing mode, the controller 1 of the liquid discharging apparatus 100 executes printing using the nozzles 47 of the overlap region Y1. The overlap region Y1 is a region in which there are many nozzles 47 in the second direction (X axis direction) and so an image of high print quality can be obtained.

Further, when the printing mode is the second printing mode, the controller 1 executes printing using the nozzles 47 of both the overlap region Y1 and the non-overlap region Y2. The number of the nozzles 47 is increased in the first direction (Y axis direction) due to employing the non-overlap region Y2 in addition to the overlap region Y1, enabling the printing speed to be increased. This enables the productivity of the liquid discharging apparatus 100 to be raised.

Second Embodiment

Figure 7:
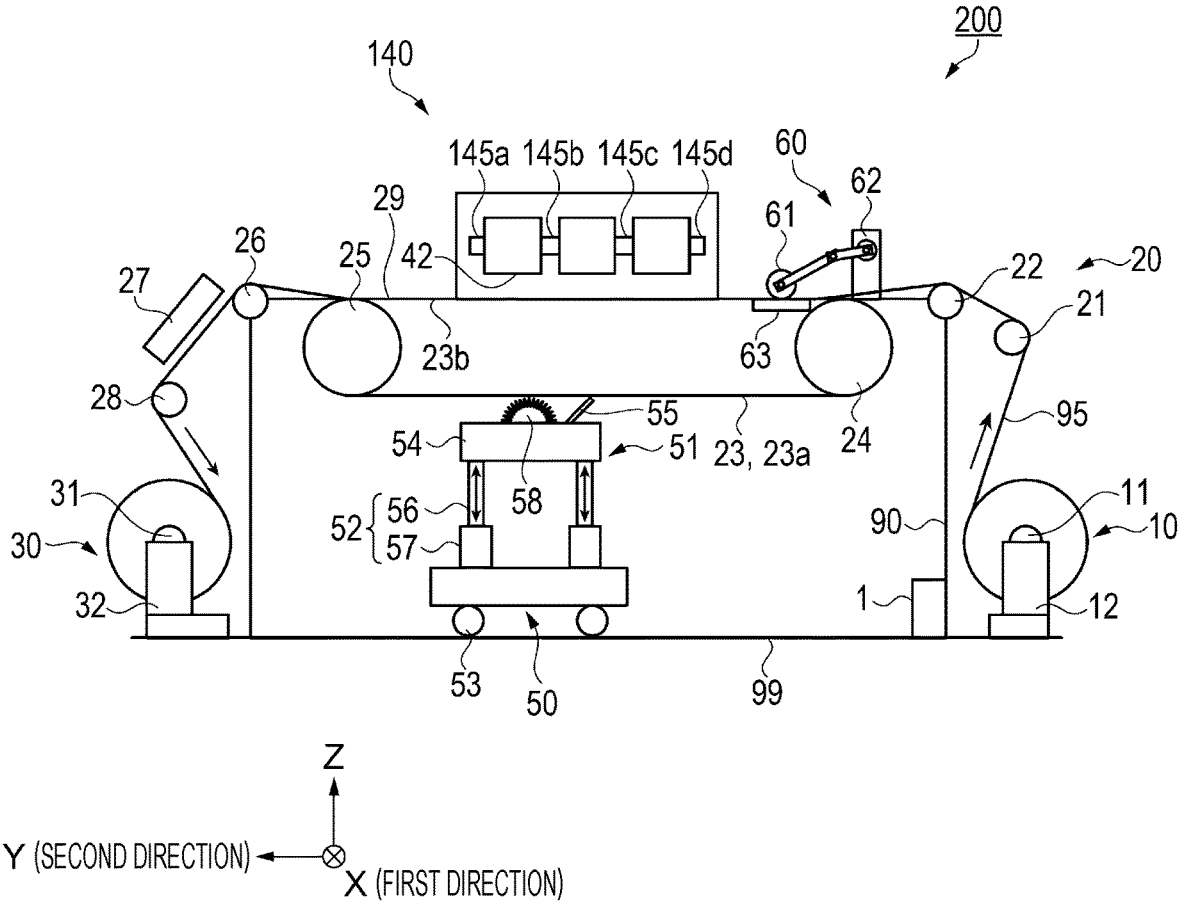
FIG. 7 is a schematic diagram illustrating an overall schematic configuration of a liquid discharging apparatus according to a second embodiment.
Figure 8:
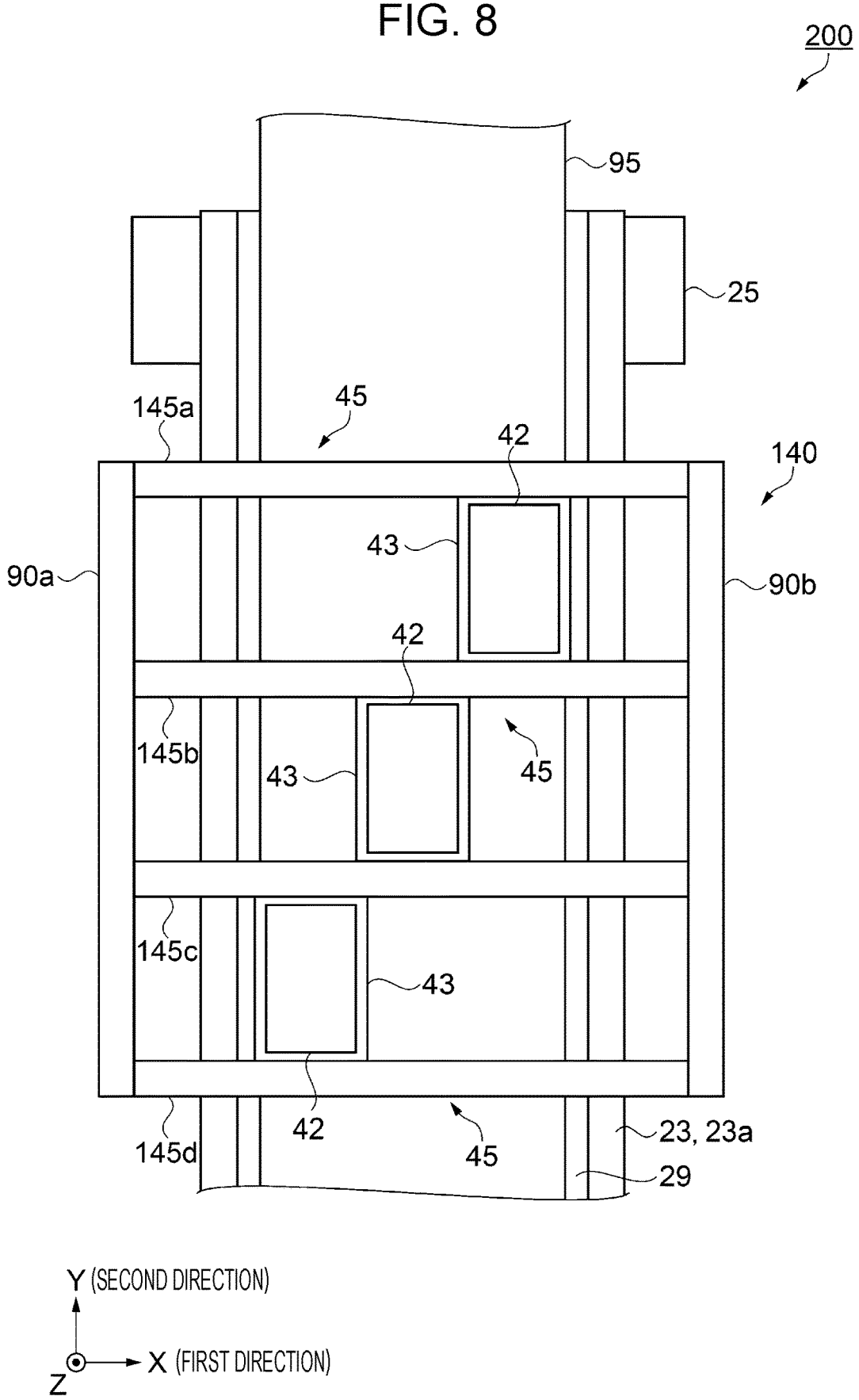
FIG. 8 is a plan view illustrating a printing unit of a liquid discharging apparatus.

FIG. 7 is a schematic diagram illustrating an overall schematic configuration of a liquid discharging apparatus according to the second embodiment. FIG. 8 is a plan view illustrating a printing unit of the liquid discharging apparatus. First, description follows regarding an overall schematic configuration of a liquid discharging apparatus 200 according to the present embodiment, with reference to FIG. 7 and FIG. 8. Note that the same reference numerals are used for configuration elements that are the same as in the first embodiment, and duplicate description thereof will be omitted. In the present embodiment, an example will be given of the liquid discharging apparatus 200 as a line head liquid discharging apparatus that prints by discharging liquid from a fixed head unit 42 onto a medium 95 that moves.

As illustrated in FIG. 7, the liquid discharging apparatus 200 includes a medium transport unit 20, a medium adhering unit 60, a printing unit 140, a drying unit 27, a cleaning unit 50, and the like. Note that in the present embodiment the Y axis corresponds to a second direction, and the X axis corresponds to a first direction. The medium transport unit 20 serving as a transport section transports the medium 95 in the second direction (Y axis direction).

The printing unit 140 is disposed above (on the +Z axis side of) the placement position of the transport belt 23, and prints on the medium 95 that moves together with the transport belt 23. The printing unit 140 includes three head units 42, carriages 43 respectively mounted with the head units 42, a carriage mover 45 to move the carriage 43 in the X axis direction when performing maintenance, and the like. The three head units 42 are respectively supported through carriages 43 by guide rails 145*a*, 145*b*, guide rails 145*b*, 145*c*, or guide rails 145*c*, 145*d*. The guide rails 145*a*, 145*b*, 145*c*, 145*d* span between vertical frame sections 90*a*, 90*b* provided at the outsides of the transport belt 23.

The head units 42 are configured so as to discharge liquid onto a medium 95 when in a fixed state. More precisely, the head units 42 having nozzle rows 44 running along the first direction are provided so as to be arranged in a row along the X axis direction. The three head units 42 are fixed at positions enabling the whole width (width in the X axis direction) of the medium 95 to be printed by the three head units 42 when printing on the medium 95. The three head units 42 discharge liquid toward the medium 95 that is moving along the second direction (Y axis direction). Images or the like are thereby printed on the medium 95. The liquid discharging apparatus 200 is provided with the head units 42 described in detail in the first embodiment, and so is able to suppress a reduction in printing quality caused by individual differences between the heads 41. Moreover, due to the discharge sequence of each of the colors staying the same even when the movement direction of the medium 95 is changed, a reduction in printing quality caused by discharge sequences differing can be suppressed.

Note that in the present embodiment an example is given of a configuration in which the three head units 42 are employed in the printing unit 140; however, the printing unit 140 may be configured with any number of the head units 42 that enables the width of the medium 95 to be recorded on. Namely, the printing unit 140 may be configured by employing one head unit 42, or may be configured by employing plural, i.e. two or more, of the head units 42.

When there is a need to perform maintenance on the nozzles 47, the three head units 42 are moved to-and-fro between maintenance sections provided in the X axis direction, not illustrated in the drawings, and their fixed positions.

As described above, the liquid discharging apparatus 200 according to the present embodiment enables the following advantageous effects to be obtained.

The liquid discharging apparatus 200 includes the medium transport unit 20 to transport the medium 95 in the second direction, and liquid is discharged from the fixed head units 42 onto the medium 95 that is moved by the medium transport unit 20. The medium 95 and the head unit 42 thereby move relative to each other, and an image is printed on the medium 95. The liquid discharging apparatus 200 configured as described above employs the head units 42 capable of suppressing a reduction in printing quality such as that caused by the discharge sequence of the colors differing, or that caused by individual differences between the heads 41. Thus the liquid discharging apparatus 200 is able to suppress a reduction in printing quality such as that caused by the discharge sequence of the colors differing, or that caused by individual differences between the heads 41.

Note that the invention is not limited to the embodiments described above, and various modifications, improvements, and the like may be made to the embodiments described above. A modified example is given below.

MODIFIED EXAMPLE

Figure 9:
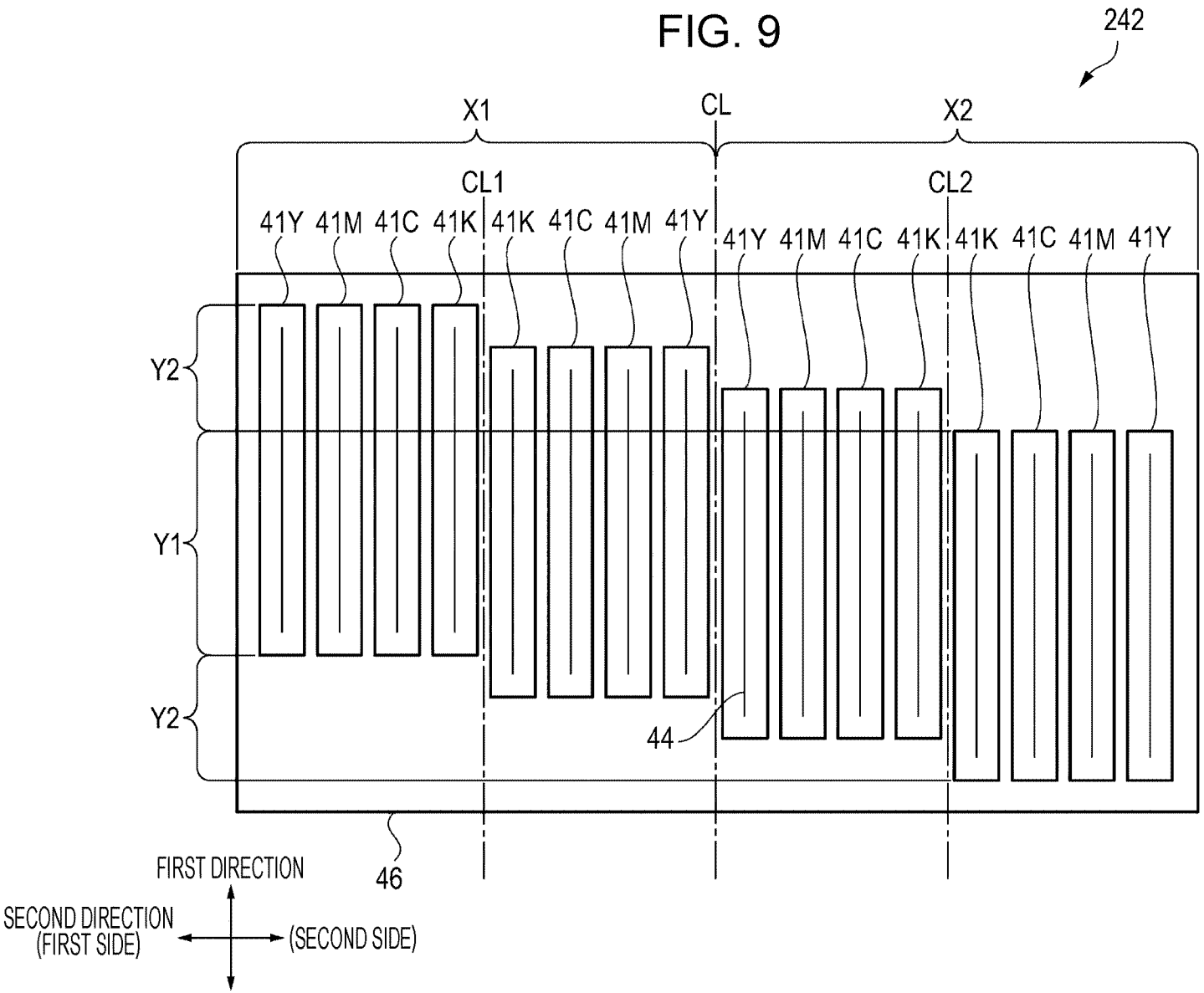
FIG. 9 is a plan view illustrating configuration of a head unit according to a modified example.

FIG. 9 is a plan view illustrating configuration of a head unit according to a modified example. A head unit 242 according to the modified example will be described with reference to FIG. 9. Note that the same reference numerals are used for configuration elements that are the same as in the first embodiment, and duplicate description thereof will be omitted.

The heads 41 that are disposed in at least one region out of a first region X1 and a second region X2 of the head unit 242 include first heads 41 and second heads 41, with the first heads 41 and the second heads 41 being at different positions in a first direction. More precisely, in each of the first region X1 and the second region X2, there is a pair of heads 41Y, 41M, 41C, 41K provided with nozzle rows 44 discharging the same color of ink. For example, in the first region X1, if one of a pair of heads 41Y corresponding to yellow is a first head 41Y and the other is a second head 41Y, then the first head 41Y and the second head 41Y are disposed at different positions in the first direction.

In the present modified example, similarly, each head of a pair of heads 41M corresponding to magenta, of a pair of heads 41C corresponding to cyan, and of a pair of heads 41K corresponding to black, are also respectively disposed at different positions in the first direction. Moreover, in the present modified example, the each head of pairs of heads 41Y, 41M, 41C, 41K disposed on the second region X2 are also respectively disposed at different positions in the first direction.

With the head unit 242 of the present modified example, even if streaks are formed along the second direction by the first direction end portions of the heads 41Y, 41M, 41C, 41K, such streaks can be made even more difficult to discern due to the streaks being more distributed in the first direction than was the case with the head unit 42 illustrated in the first embodiment.

This application claims priority under 35 U.S.C. § 119 to Japanese Patent Application No. 2017-015153, filed Jan. 31, 2017. The entire disclosure of Japanese Patent Application No. 2017-015153 is hereby incorporated herein by reference.

What is claimed is:

1. A head unit comprising:

heads each including a nozzle row including a plurality of nozzles that discharge liquid onto a medium and that are arranged along a first direction; and a body in which the heads are arranged along a second direction that intersects with the first direction, wherein each of a first color set of four or more of the heads includes a nozzle row corresponding to a first color, two or more of the heads of the first color set of heads being provided in a first region and two or more of the heads of the first color set of heads being provided in a second region, the first region being on one side of a center of the body in the second direction and the second region being on another side of the center of the body in the second direction, wherein each of a second color set of four or more of the heads includes a nozzle row corresponding to a second color that is different than the first color, two or more of the heads of the second color set of heads being provided in the first region and two or more of the heads of the second color set of heads being provided in the second region, wherein for each of the nozzle rows of at least the first color and the second color, a color corresponding to the nozzle row at an nth position from a first side of the body is the same as a color corresponding to the nozzle row at an nth position from a second side of the body, n being a positive integer, the first side being one side of the body in the second direction and the second side being a side of the body opposite from the first side in the second direction, wherein the first color set of heads and the second color set of heads in the first region or the second region is arranged in reverse order, and wherein for each of the nozzle rows of at least the first color and the second color, the nozzle row at an nth position from the first side in the first region corresponds to the same color as the nozzle row at an nth position from the second side in the first region, n being a positive integer, and the nozzle row at an nth position from the first side in the second region corresponds to the same color as the nozzle row at an nth position from the second side in the second region, n being a positive integer.

2. The head unit according to claim 1, wherein the heads disposed in the first region and the heads disposed in the second region are shifted from each other in the first direction.

3. The head unit according to claim 2, wherein:

the heads disposed in the first region include a first head and a second head, and the first head and the second head are shifted from each other in the first direction.

4. The head unit according to claim 3, wherein the heads disposed in the second region include a third head and a fourth head, and the third head and the fourth head are shifted from each other in the first direction.

5. A liquid discharging apparatus comprising the head unit of claim 4.

6. A liquid discharging apparatus comprising the head unit of claim 2.

7. A liquid discharging apparatus comprising the head unit of claim 3.

8. A liquid discharging apparatus comprising the head unit of claim 1.

9. The liquid discharging apparatus according to claim 8, further comprising a controller that controls the head unit to print an image on a medium, wherein the heads disposed in the first region and the heads disposed in the second region overlap with each other in an overlap region of the head unit as viewed from the second direction, and the heads disposed in the first region and the heads disposed in the second region do not overlap with each other in a non-overlap region of the head unit as viewed from the second direction, the controller being configured to:

prints an image on the medium using the heads in the overlap region when executing printing in a first printing mode, and prints an image on the medium using the heads in the overlap region and in the non-overlap region when executing printing in a second printing mode.

10. The liquid discharging apparatus of claim 8, further comprising a transport section that transports the medium in the first direction, wherein the head unit being configured to discharge liquid onto the medium while the head unit is moving along the second direction.

11. The liquid discharging apparatus of claim 8, further comprising a transport section that transports the medium in the second direction, wherein the head unit being configured so as to discharge liquid onto the medium while the head unit is in a fixed state.

12. A head unit comprising:

a body having a first end and a second end at opposite ends of the body in a second direction that intersects a first direction;

heads arranged in the body along the second direction, each head including a nozzle row including nozzles that discharge liquid onto a medium, each nozzle row being arranged along the first direction, the heads including:

a first color set of at least four heads, each having a nozzle row corresponding to a first color, two or more of the first color set of heads provided to one side of a center of the body in the second direction, two or more heads of the first color set of provided to another side of the center of the body in the second direction, a second color set of at least four heads, each having a nozzle row corresponding to a second color that is different than the first color, two or more of the second color set of heads provided to one side of the center of the body in the second direction, two or more heads of the second color set of provided to another side of the center of the body in the second direction, wherein for each nozzle row corresponding to each of at least the first and second colors, the nozzle row at an nth position from the second end of the body corresponds to the same color as the nozzle row at an nth position from the first end of the body, wherein n is a positive integer, wherein the first color set of heads and the second color set of heads in the first region or the second region is arranged in reverse order, and wherein for each of the nozzle rows of at least the first color and the second color, the nozzle row at an nth position from the one side in a first region corresponds to the same color as the nozzle row at an nth position from the other side in the first region, n being a positive integer, and the nozzle row at an nth position from the one side in a second region corresponds to the same color as the nozzle row at an nth position from the second side in the second region, n being a positive integer.

* * * * *